US011364940B1

(12) United States Patent
Williams

(10) Patent No.: US 11,364,940 B1
(45) Date of Patent: Jun. 21, 2022

(54) ADAPTIVE ROUTE RAIL SYSTEM WITH PASSIVE SWITCHES

(71) Applicant: Thomas Holtzman Williams, Longmont, CO (US)

(72) Inventor: Thomas Holtzman Williams, Longmont, CO (US)

( * ) Notice: Subject to any disclaimer, the term of this patent is extended or adjusted under 35 U.S.C. 154(b) by 0 days.

(21) Appl. No.: 17/460,188

(22) Filed: Aug. 28, 2021

(51) Int. Cl.
*B61F 13/00* (2006.01)

(52) U.S. Cl.
CPC ..... *B61F 13/00* (2013.01)

(58) Field of Classification Search
CPC ... B61F 13/00; E01B 5/14; E01B 7/00; E01B 7/10; E01B 7/12; E01B 9/00
See application file for complete search history.

(56) References Cited

U.S. PATENT DOCUMENTS 3,874,299 A * 4/1975 Silva ..... B61F 9/00 104/130.02
3,902,428 A * 9/1975 Peveraro ..... E01B 25/00 104/130.07
4,862,807 A * 9/1989 Guadagno ..... B61B 1/00 104/130.07

* cited by examiner

*Primary Examiner* — Robert J McCarry, Jr.

(57) ABSTRACT

A railroad switch (in USA), turnout, or [set of] points (Europe) is a mechanical installation enabling railway trains to be guided from one track to another, such as at a railway junction or where a spur or siding branches off. This invention describes a rail transportation system that allows vehicles to change tracks at railroad switch locations while all supporting and guiding rails remain static. Vehicles have diverters that apply lateral force to direct the vehicle to go onto the desired track, right, left, or straight ahead. This is enabled by the diverters plus rail wheels that have inside flanges and wide cylindrical surfaces. This innovation allows rail vehicles to travel through a connected rail system like a highway system that is transporting trucks, buses, and cars on paved roads. This system may operate under a computerized traffic control system and allows mass transit systems to respond to ride requests, enabling 24-hour route-adaptive mass transit. The track system can be placed into a road, like tram (or street cars) tracks. Vehicle can form into coupled trains while moving, and passengers can change routes in transit by changing coupled cars. Rail switches can be static for self-switching vehicles, but normally static components can adapt to accommodate conventional rail-switched rail vehicles.

20 Claims, 10 Drawing Sheets

ADAPTIVE ROUTE RAIL SYSTEM WITH PASSIVE SWITCHES

CROSS REFERENCE TO RELATED APPLICATIONS

This application claims benefit and priority of U.S. Provisional Patent Application Ser. No. 62/918,544 filed Feb. 4, 2019, and U.S. Non-Provisional patent application Ser. No. 16/780,015 filed Feb. 3, 2020, U.S. Non-Provisional patent application Ser. No. 17/072,664 filed Oct. 16, 2020, U.S. Provisional Patent Application 63/133,509 filed Jan. 4, 2021. The disclosures of this application are incorporated herein by reference in their entireties.

FIELD

This invention relates to rail system in general and to track switching systems in particular.

BACKGROUND

There is currently a confluence of factors creating a need for improved efficient mass transit, both public and private. The factors include high population densities, global warming caused by transportation's creation of CO2, wasting of productive time, passenger safety and comfort, traffic congestion, and inefficient mass transit systems running on fixed schedules over stationary routes. Frequently, using mass transit means walking long distances to a terminal, waiting outdoors in inclement weather for a bus or train, waiting at another location for another bus or train on another line, and then walking long distances from the terminal to the end location.

Roads are flexible, and they can be used by cars, trucks and buses, or human powered vehicles. They are also very expensive, and trucks carrying heavy load destroy roads. Roads use more real estate relative to rail tracks.

Rails, on the other hand, are cheap on a per-km basis, but inflexible. They are generally point-to-point systems on straight (non-divergent) lines. Mechanical switching means in the rails are required for a vehicle on the rail to change routes onto different tracks. Vehicles with hard wheels on steel rails have much lower rolling resistance than rubber tires on roads, which results in much better fuel economy in terms of energy required to move a ton of material one km.

It is an object of this invention to create a transportation system for efficiently transporting people or material over a network of connected rails under computer control. It is also an object of this invention to allow efficient flexible routing of vehicles over a rail network employing interconnected rails.

It is also an object of this invention to allow self-routing vehicles to use common tracks with conventional trains enabled by switches placed into a neutral position. That is, switches are set to a middle or neutral position where a self-routing vehicle can choose right or left. When the switch is taken out of the neutral position, conventional rail vehicles and trains will be directed left or right.

It is also an object of this invention to create a material handling system that may be used inside warehouses, factories, and mines.

It is also an object of this invention to build an economically advantageous hybrid train/truck system offering advantages of both transit systems.

It is also an object of this invention to create a toy or a model.

SUMMARY OF THE INVENTION

A system for rail transportation comprised of stationary rail junctions with alpha, beta, gamma, delta, epsilon and zeta rails, four flange paths, and rails vehicles with rail wheels incorporating flanges and wide cylindrical surfaces, and diverters that select tracks at a junction by applying lateral force to left or right side surfaces at said junction. Diverter means for applying lateral force on a vehicle are by rollers, directed force, steered road wheels, or magnetic attraction.

Said single vehicle can couple and decouple while moving to form cars in trains under system control. Passenger can change cars in coupled trains to effect destination.

Said vehicles can adaptively change routes under control of a traffic control system by switching at junctions.

DESCRIPTION FIG. 1A

Figure 1A:
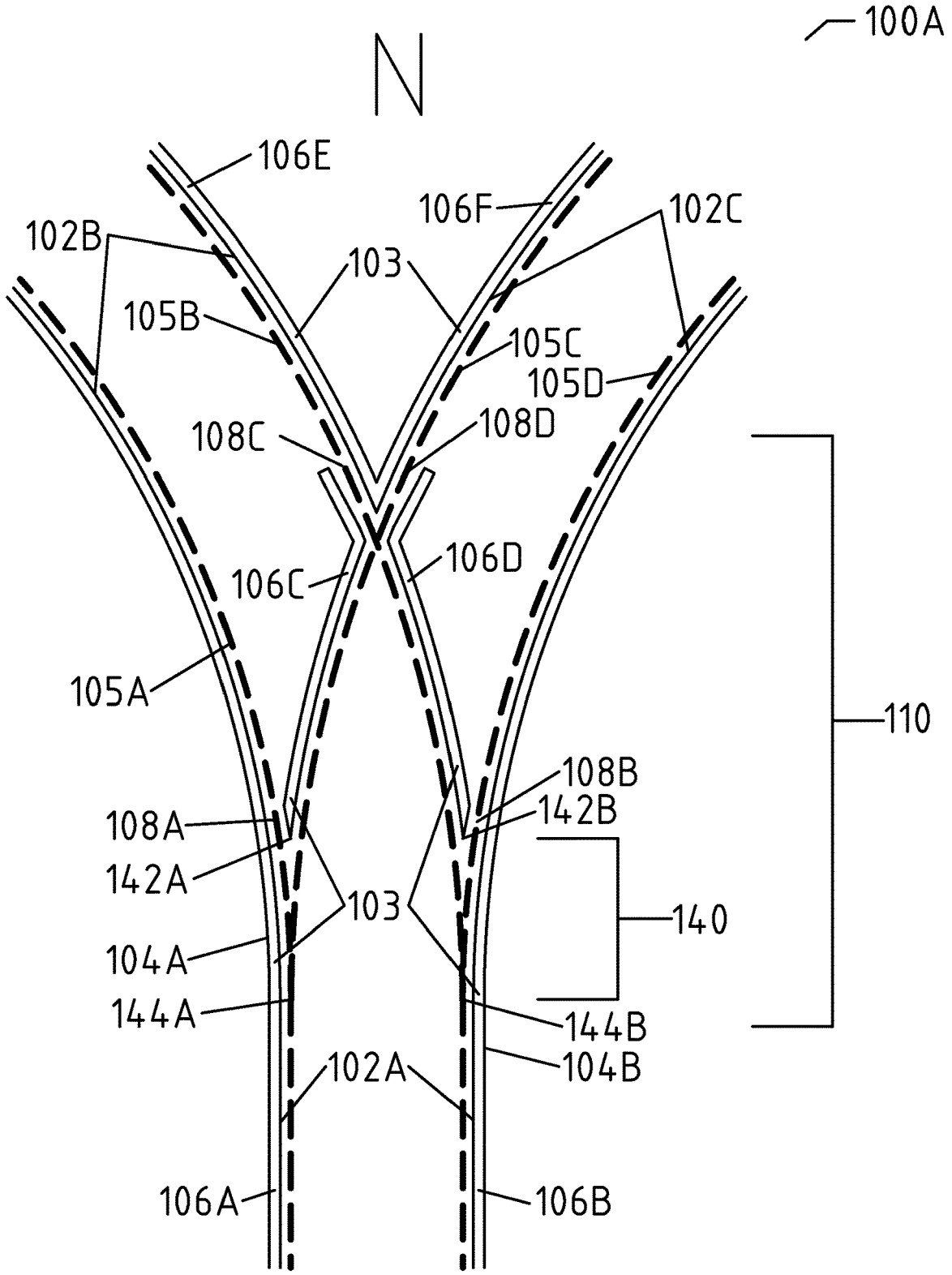
FIG. 1A is a top view of a passive rail junction.

FIG. 1A is a top view 100A of a passive rail junction 110 to allow track switching by a vehicle. All rails illustrated in FIG. 1A remain stationary. The direction North is at the top of the drawing. An incoming track 102A from the South divides to connect with a left track 102B and a right track 102C. The junction is comprised of stationary rail segments with multiple stationary rails. The junction 110 is comprised of a continuous alpha rail 106A on the left, a continuous beta rail 106B on the right, a gamma rail 106C, a delta rail 106D, an epsilon rail 106E and a zeta rail 106F. A rail top surface 103 is defined as the top plane of the rails when the rail bottoms are situated on a horizontal plane. Rails 106A-F have approximately the same rail top surface 103. A left side surface 104A is located on the outside vertical edge of alpha rail 106A and a right side surface 104B is located on the outside vertical edge of beta rail 106B. There are gaps between the tracks for wheel flange clearance. Gaps are situated below the rail top surface 103, including alpha gap 108A, beta gap 108B, gamma gap 108C, and delta gap 108D. Stationary track segments may be mounted on ties (or sleepers) supported by ballast, which can be crushed rock. An improved construction method is to have junction track segments fabricated together to maintain accurate alignment, distances and spacing.

Also illustrated as heavy dashed lines are flange paths 105A, 105B, 105C, and 105D. These flange paths extend below the rail top surfaces and are used for clearance by front and back rail wheel flanges when making left or right turns. They allow wheel flanges to pass through gaps 108A-D. Flange path 105A passes through rails 106A and 106C. Flange path 105B passes through rails 106C and 106E. Flange path 105C passes between rails 106D and 106F. Flange path 105D passes between rails 106D and 106B.

Tracks at other non-junction locations can be standard prior-art construction with standard uniform rail-to-rail spacing.

A gamma extension 106CX on the gamma rail 106C and a delta extension 106DX on the delta rail 106D are optional but provide a guide for wheels on vehicles coming from Northeast or Northwest. The gamma extension 106CX and delta extension 106DX also allow wide rail wheel cylinders to remain supported from underneath while making turns. Without the angular extensions a wheel could potentially make a "click" sound while passing over gaps in the rails.

There is a decision distance 140 between the locations 144A and 144B where the flange paths separate to the points 142A and 142B on the South ends of the gamma rail 106C and delta rail 106D respectively. A decision distance 140 is in important feature because a vehicle of the present invention must decide to go Northeast or Northwest and have its wheels flanges in position to pass through gap 108A or gap 108B. Over the decision distance the presence of the spreading (increased separation) between the alpha rail 106A and the beta rail 106B also present an obstacle (i.e. derailment) to prior art rail wheels that do not have wide cylinder portions, as will be explained in FIG. 1B.

The distance between rails at a start of a decision distance is a standard rail spacing and is wider at an end of the decision distance.

DESCRIPTION FIG. 1B

FIG. 16 is a top view 100B of a vehicle 112 that operates on the rails of FIG. 1A. Vehicle 112 has rail wheels 118A, 118B, 118C and 118D that support the vehicle 112. Each wheel, such as wheel 118A is mounted on an axle such as axles 114A and 114B. Wheel 118A (typical) has a flange 124A and a wide cylindrical portion, such as wide cylinder 122A. The wide cylinder portion of a rail wheel should be at least as wide as the top of a rail, plus flange width, plus a tolerance for mechanical variation.

A chassis 120 is illustrated as dashed lines. Each pair of wheels is illustrated as rotating around a common axle, such as the axles 114A and 114B. Both axles 114A and 114B may be rotatably connected to the chassis 120 through supports such as axle support 116A. The axles may rotate within supports, or the wheels may rotate around said axles. A suspension, not illustrated, is optional and is desirable.

Vehicle 112 also has a left diverter 115C which in this embodiment is a roller and is illustrated in a down position, and a right diverter 115D illustrated as a roller in an up position. Optional left diverter 115A is illustrated in a down position, and optional right diverter 115B is illustrated in an up position. Diverters go up and down to select which way to turn going into junctions when going North. All diverters may remain in the up position when going South into and through a junction. Mounting of the diverter 115A-D with rollers to the chassis 120 is not illustrated in this drawing. The diverters 115A and 115C are in a down position and contact left rail side 104A to force the vehicle 112 to make a left turn. Diverters 115B and 115D are in an up position to clear rail top surfaces 103. Diverters 115A and 115C can rotate up and down together, and diverters 115B and 115D can rotate up and down together. When traveling on segments of track not containing a junction, all the diverters can be in up position. The sets of vertical parallel lines at the top and bottom of the drawing locate rail placement for rails 106A and 106B.

Optional diverters 115A and 115B improve a vehicle's ability to turn at a junction when traveling backwards. If the vehicle is not backing up, the optional diverters are not required. Diverter performance is improved if the diverters are located close to a front wheels 118C and 118D. Diverters can be located ahead of a wheel, adjacent to the wheel, or behind the wheel as illustrated. Good diverter performance can be measured by an amount of lateral force required to make a turn, friction generated between rail wheel flange and rail, and a speed at which a turn can be made.

DESCRIPTION FIG. 1C

Figure 1C:
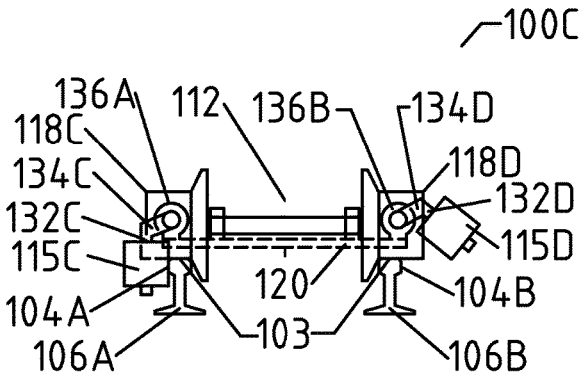
FIG. 1C is a sectional view of a vehicle that operates on the rails of FIG. 1A.

FIG. 1C is a sectional view 100C (A-A' in FIG. 1B) of the vehicle 112 that operates on the rails of FIG. 1A. It is mounted on rails, such as alpha rail 106A and beta rail 106B before a turn, and alpha rail 106A and epsilon rail 106E, or zeta rail 106F and beta rail 106B after a turn. Wheel 118C is contacting rail 106A with rail top surface 103, and wheel 118D is contacting rail 106B with rail top surface 103. The diverter 115C is touching side surface 104A and diverter 115D is elevated above rail top surface 103 and not touching side surface 104B. Diverter roller axle 132C attaches diverter 115C to pivot arm 134C. Pivot arm 134C is rotatably attached to chassis 120 through pivot arm support 136A.

Means to rotate pivot arms are not illustrated but may be a linear or rotary actuator, electrical, hydraulic, or pneumatic. Likewise, they may be mechanical levers that are hand or foot operated.

DESCRIPTION FIG. 1D

Figure 1D:
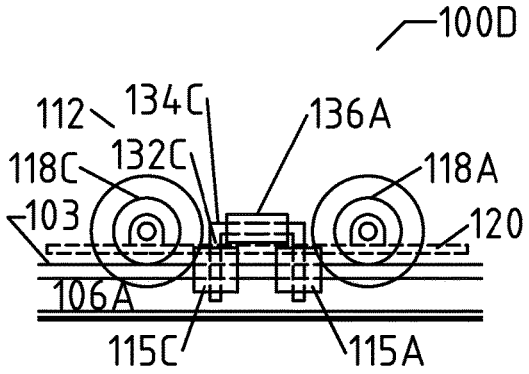
FIG. 1D is a side view of a vehicle that operates on the rails of FIG. 1A.
Figure 1B:
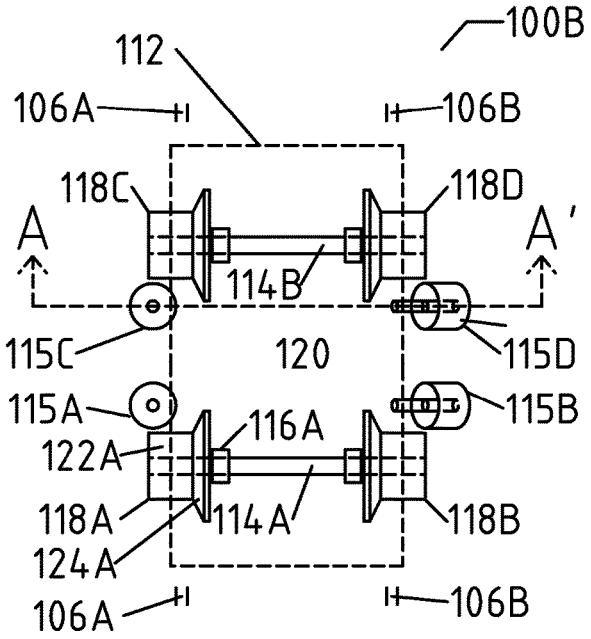
FIG. 1B is a top view of a vehicle that operates on the rails of FIG. 1A.

FIG. 1D is a left side view 100D of vehicle 112 that operates on the tracks of FIG. 1A. Vehicle 112 rides on the alpha track 106A and the beta track 106B. Diverters 115A and 115C are in a down position. Pivot arm 134C rotates in pivot arm support 136A.

DESCRIPTION FIG. 1E

Figure 1E:
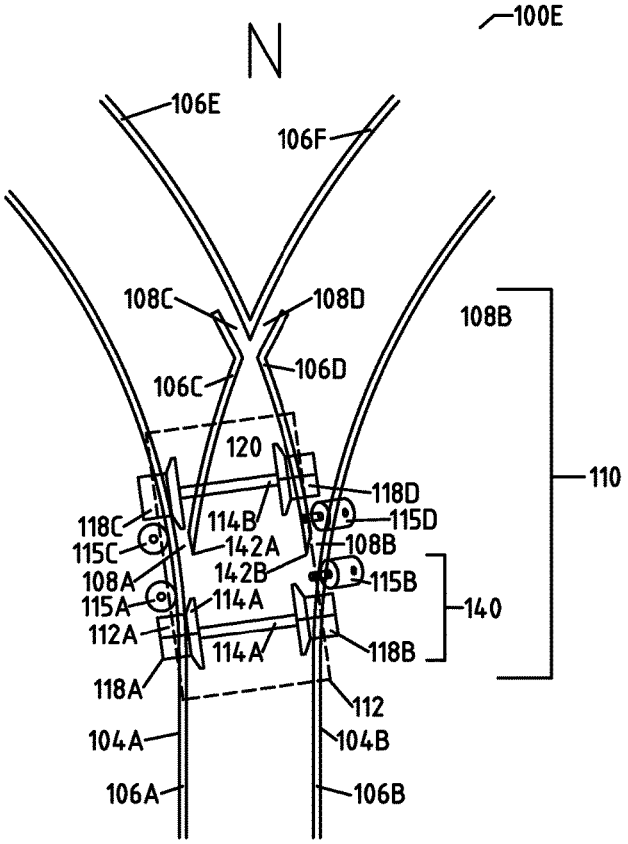
FIG. 1E is a top view of a vehicle in a turn on the rails of FIG. 1A.

FIG. 1E is a top view 100E of vehicle 112 in a turn on the rails of FIG. 1A. The vehicle 112 is headed Northwest. The vehicle is illustrated as being in the process of making a left turn at a rail junction 110. Diverter 115A and 115C are lowered contacting side surface 104A, and diverter 115B and 115D are raised. If the vehicle were making a right turn, the 115B and 115D diverters would be lowered and touching side surface 104B, and diverters 115A and 115C would be raised above rail top surface. Wheel flanges on wheels 118A and 118C pass through gap 108A and flanges on wheels 118B and 118D pass through gap 108C. For a right turn a same symmetrical process is followed with diverters 115B and 115D lowered and diverters 115A and 115C raised.

Note that vehicle 112 as illustrated has 2 side rollers on each side. Optionally rear diverters 115A and 115B may be removed or kept in an up position. As mentioned above, they are mainly functional when vehicle 112 is backing up, enabling higher speed turns with lower force on rail side surfaces. Diverter 115C ensures flange on wheel 118C passes through gap 108A. The rear wheel, 118A follows the front wheel 118C on short vehicle in a tight turn. On long vehicles, and for vehicles that regularly back up, rear diverters 115A and 115B are useful and should be employed.

Note that lowering side rollers is only necessary coming into the junction 110 from the South. Coming from the North side, all rollers can remain up and the vehicle 112 glides through the junction 110 from either the Northeast or Northwest.

There is a tradeoff between rail turn radius and distance between axles 114A and 114B. If the track radius is too small, contact will be made between flanges and the edges of the tracks. If one or both axles were made steerable, the vehicle could go around tighter (smaller radius) curves without the wheel flanges contacting the inside of the rails. Smaller radius track curves allow the use of less real estate, but force vehicles to slow down more.

Another issue with rail wheels fixed to rotatable axles is that when going around curves, one wheel must travel a longer distance than the wheel on the other side when going around the curve. If they rotate together, the result is friction from sliding and a squeaking noise on a tight curve. For tight turns with self-powered vehicles, it is desirable to optionally unlock wheel rotation from a same axis, and then optionally relock after relatively straight travel is again encountered. For vehicles that are pushed or pulled, (without self-power), all wheels can rotate freely on fixed axles. Alternately a differential or a clutch mechanism can be used.

Another operational issue for rail system designer is the decision distance 140 over which lateral force must be applied. The vehicle must be pulled (or steered or forced) to go right or left before reaching a decision point (DP). The DP is at end of the decision distance 140 and a location where front wheels of vehicle must be on a desired side of the alpha or beta track. Over the length of the decision distance, the track spacing increases to make room for the passage of wheel flanges. So, the cylindrical portion of the rail wheels needs to be sufficiently wide to prevent derailment. Again, the decision distance 140 is the length between the points at which the flange paths separate and the points 142A and 142B. That is, at the start of the decision distance, the rail spacing is uniform. At the end of decision distance, the rails 106A and 106B are separated, and the wheel flanges on wheels 118C or 118D need to be on the selected side for a right or left turn. Speed is important in that the decision distance may be traversed in a fraction of a second at high speeds. Because human reaction time is not fast enough, it is desirable to have the decision distance long for high-speed operation, and diverter control should ideally be automated. A longer decision distance also provides a more comfortable ride for passengers on vehicle 112. Large radius turns are also important for high-speed turns, both for safety and passenger comfort.

The vehicle's wheels 118A-D are comprised of axle attachments, flanges and wide cylinders contacting the rails. On conventional rail wheels, the relatively narrow cylindrical surface is typically slightly tapered. This causes the vehicle to center itself between the tracks and limits the contact of the flanges with the rails. On wheels 118A-D, the wide cylindrical surface may be either tapered or uniform. The wide cylindrical surfaces are made wider than on conventional rail wheels to bridge gaps 108A-D in the rail surface while making a turn. The gaps 108A-D allow for flange clearance for wheels on vehicles taking either path.

Long train cars, such as boxcars, have support wheel sets on both ends. They are called "bogies" and pivot underneath a long train car. A pair of vehicles, such as vehicle 112 with diverters and with rotating supporting pivots added to the tops (not illustrated), may be used on both ends of a long car to support it on the rails.

DESCRIPTION FIG. 1F

Figure 1F:
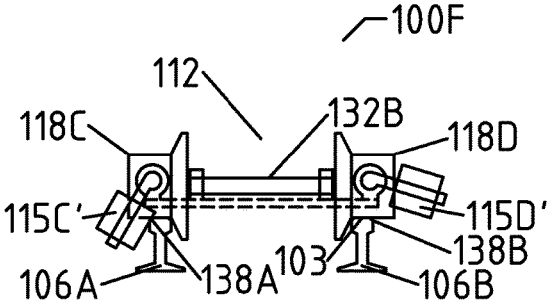
FIG. 1F is a sectional end view of a vehicle with a modified diverter roller.

FIG. 1F is a sectional end view 100E of a vehicle 112 with a modified left diverter 115C' and a modified right diverter 115D'. It has been discovered working with scale models (approximately 1:20) that when side roller force on the track is relatively uncontrolled, such as when using a servo motor with no feedback, having a side roller contact the rail side surface at an angle of less than 90 degrees produces a smoother, lower friction turn. Left diverter 115C' is touching alpha rail 106A on angled contact surface 138A at approximately a 60-degree angle. Right diverter 115D' is raised above the rail top surface 103 and not touching angled contact surface 138B associated with beta rail 106B. Any angle can be used, but 60 degrees produced a smooth turn in testing. A 90-degree angle, illustrated in FIG. 1C, with excessive force, creates friction with a flange on the opposite side of the rail slowing down the vehicle 112 and causing wear on both rails and wheel flanges.

DESCRIPTION FIG. 2

Figure 2:
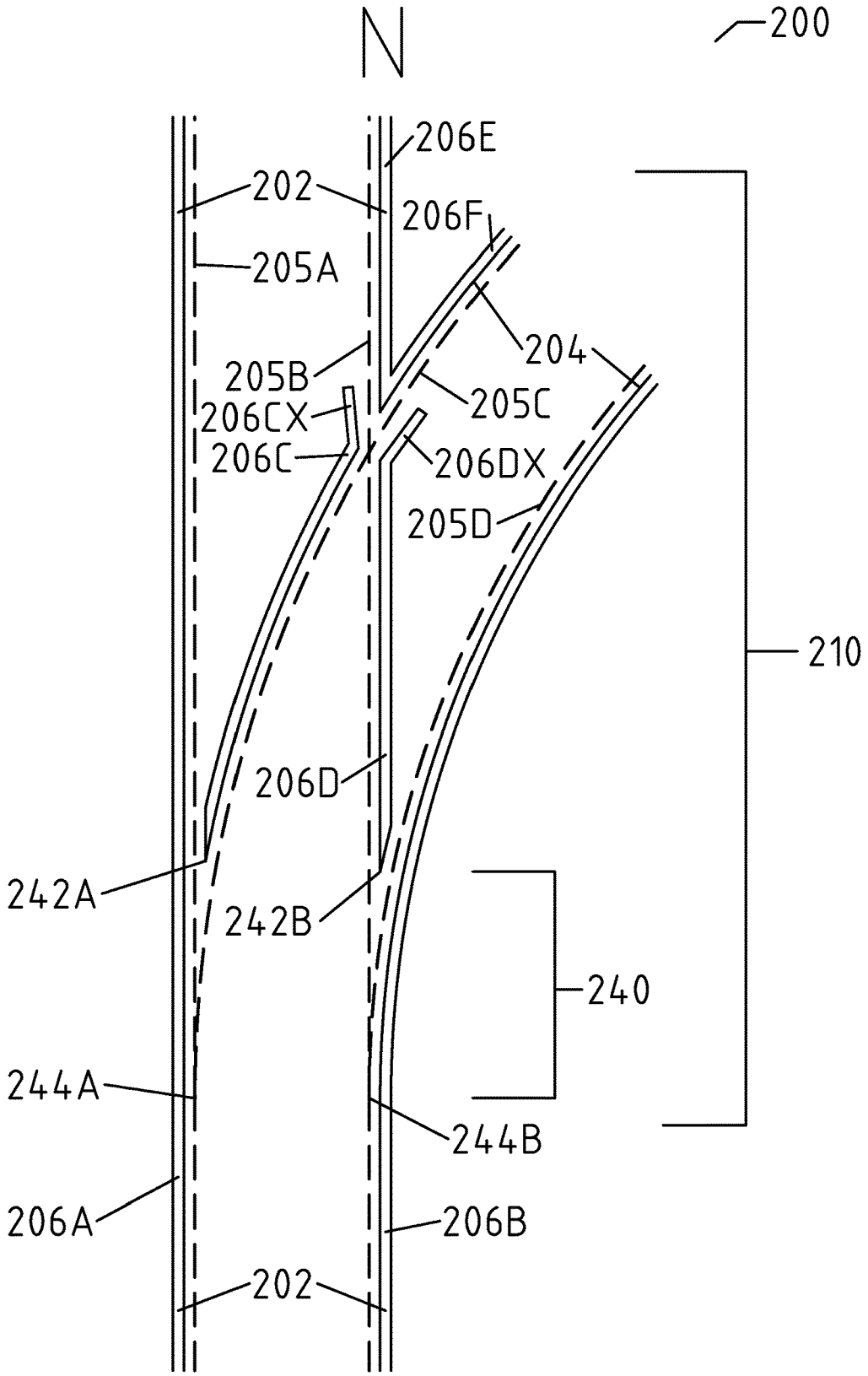
FIG. 2 is a top view of a spur line branching off a main line.

FIG. 2 is a top view 200 of a spur line 204 branching off a main line 202. Vehicle 112 (not illustrated in this figure) operates over this rail junction 210 also. This junction 210 consists of an alpha rail 206A, a beta rail 206B, a gamma rail 206C, delta rail 206D, epsilon rail 206E and zeta rail 206F. Branching lines are used for allowing vehicles to pass other vehicles traveling in the same or opposite direction, loading, and unloading passengers and freight, parking, etc. Dashed lines illustrate flange paths 205A-205D. Operation of vehicle 112 at rail junction 210 is analogous to the operation of rail junction 110 of FIG. 1E, with the exception that the main line goes straight, and the spur or branch line branches off. Branches can occur to the right, as illustrated, or to the left. A decision distance 240 is illustrated as a distance between locations 244A and 244B where the flange paths separate to the points 242A and 242B on the South ends of gamma rail 206C and delta rail 206D respectively. Optional extensions 206CX and 296DX may be used to provide better guidance and support for rail wheels while passing through gaps.

DESCRIPTION FIG. 3

Figure 3:
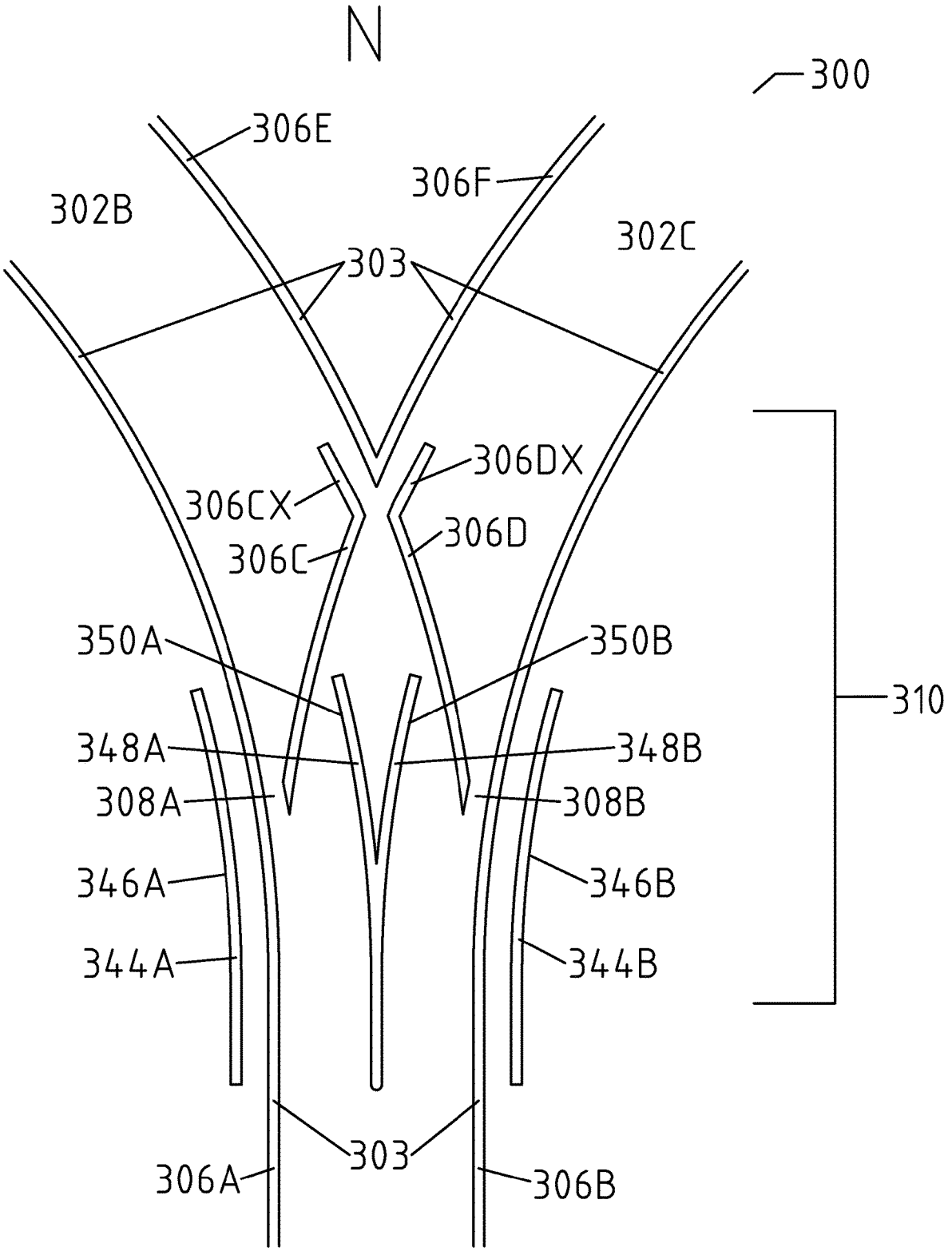
FIG. 3 is a top view of a passive rail junction using side bars and center bars.

FIG. 3 is a top view 300 of a passive rail junction 310 using optional side bars 344A and 344B and optional center bars 348A and 348B. This figure has the rail elements of FIG. 1A but with the addition of 4 added bars with outside side surfaces. They are the left outside sidebar 344A with left side surface 346A, the right outside sidebar 344B with right side surface 346B, the left center bar 348A with left side surface 350A and the right center bar 348B with right side surface 350B. These bars allow alternate methods for vehicles to apply lateral forces to stationary track structures to select tracks. A junction 310 can use both alternate optional methods, either one, or neither. These bars are only needed at junctions and need only be contacted by roller diverters on vehicles headed Northeast or Northwest.

With owners and users of vehicles, aesthetics or appearance is important for adoption. So, hiding the diverter mechanism from view is beneficial. For other vehicles, such as carts used in a mine or a factory, utility is of paramount importance.

Outside sidebars 344A and 344B are used by a vehicle illustrated in FIG. 4 to apply lateral forces. Vehicles lower diverters which may be side rollers to make contact with the left side surface 346A of the sidebar 344A or the right side surface 346B of sidebar 344B at a junction 310. The tops of sidebars 344A and 344B may be shorter than tops of rails 303, the same height, or taller.

Center bars 348A and 348B are used by vehicles described in FIG. 5. These vehicles lower diverters which may be rollers to contact the left side surface 350A of the left center bar 348A or right side surface 350B of right center bar 348B at a junction. Center bars 348A and 348B may be joined at the South end or remain unattached. The tops of center sidebars extend above the tops of rails 303 but are short enough to clear the axles or other body parts of vehicles. The left center bar 348A maintains a constant distance from alpha rail 306A and right center bar 348B maintains a constant distance from beta rail 306B.

DESCRIPTION FIG. 4A

Figure 4B:
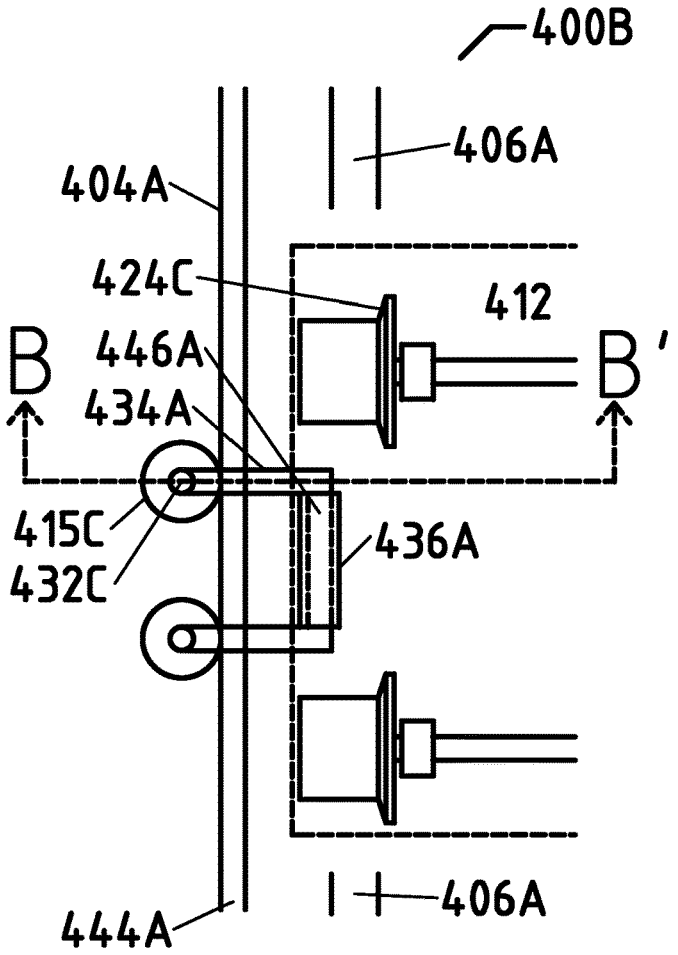
FIG. 4B is a partial top view of a vehicle on a rail using a side bar.
Figure 4A:
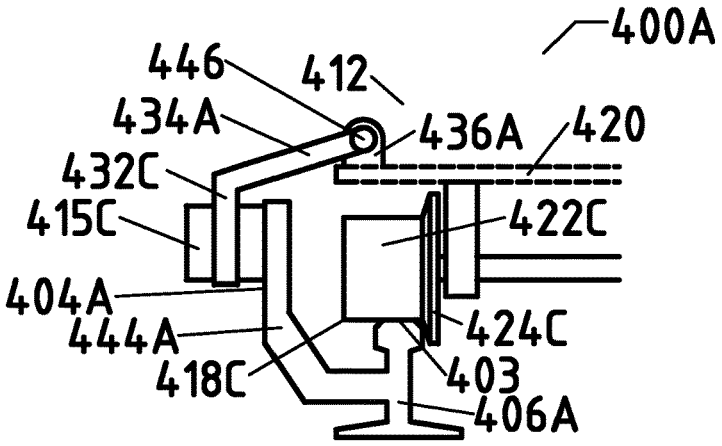
FIG. 4A is a partial end view of a vehicle on a rail using a side bar.

FIG. 4A is a partial end view 400A of a vehicle 412 on an alpha rail 406A using a side bars 444A. The vehicle 412 applies lateral force with a diverter 415 to an outside sidebar 444A to make a turn. The vehicle 412 is on the alpha rail 406A that is accompanied by, or constructed with side bars, such the sidebar 444A. Only a left side is illustrated. Wheel 418C has a wide cylinder portion 422C and a flange 424C. An outside side surface 404A of the sidebar 444A is contacted by a diverter 415C roller in a down position. Diverter 415 roller rotates on diverter roller axle 432C. Diverter roller axle 432C connects to pivot arm 434A. Pivot arm 434A connects pivot arm support 436A which connects to chassis 420. Chassis are illustrated as dashed lines. Pivot arm rotates around point 446, and is illustrated in the down position, getting ready for, in, or just finishing, a left turn.

DESCRIPTION FIG. 4B

FIG. 4B is a partial top view 400B of a vehicle on a rail using a side bar 444A. Again, only the left half is illustrated. Rail line locations for alpha rail 406A are illustrated as parallel lines above and below said vehicle.

The operation of vehicle 412 differs from vehicle 112 in that diverters 415A and 415C with side rollers apply lateral force to outside side surface 404A on sidebar 444A instead of applying lateral force to rails side surface 104A. The flanges on rail wheels on the inside of the tracks keep rail wheels on tracks, while sidebars enable turns.

Depending on vehicle length and turn radius, side diverters may need to be rotated (raised or lowered) more to keep them in contact with side surfaces 404A.

Section B-B' was illustrated as FIG. 4A.

DESCRIPTION FIG. 5A

Figure 5C:
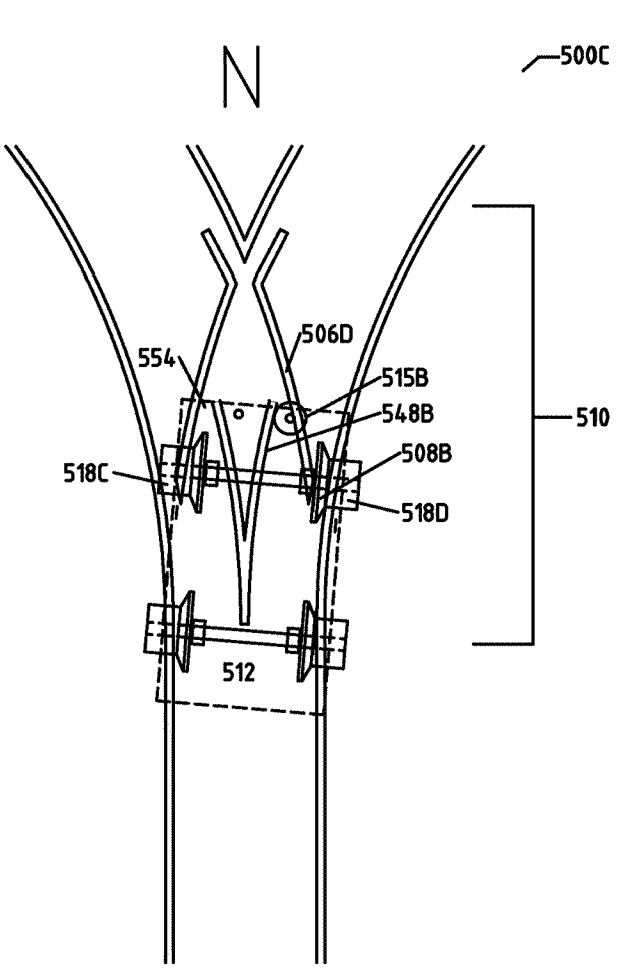
FIG. 5C is a top view of a vehicle in a turn using center bars.
Figure 5B:
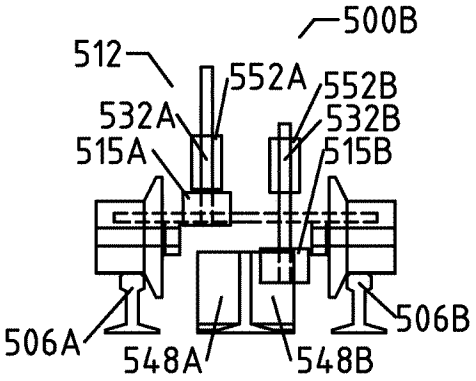
FIG. 5B is an end view of a vehicle at a junction using center bars.
Figure 5A:
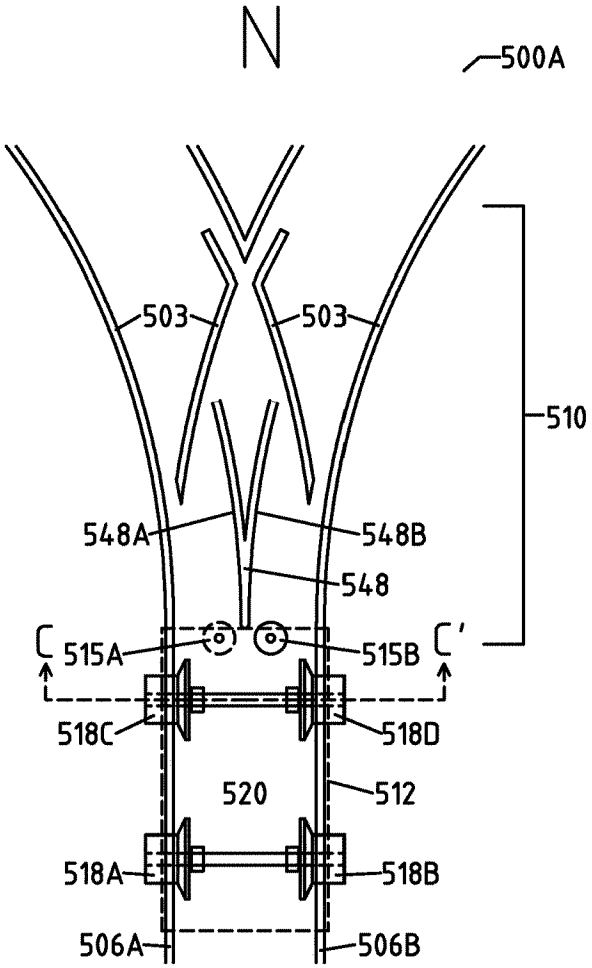
FIG. 5A is a top view of a vehicle at a junction using center bars.

FIG. 5A is a top view 500A of a vehicle 512 at a junction 510 applying lateral force to either left center bar 548A or to right center bar 548B. The vehicle 512 is riding on alpha rail 506A and beta rail 506B with wheels 518A-D supporting chassis 520. Outline of chassis 520 is shown as dashed lines. The junction features a center bar assembly 548 composed of the left center bar 548A and the right center bar 548B. The center bars 548A and 548B have a height greater than the tops of rails 503. At junction 510 bar 548A would be contacted on its left side by roller diverter 515A force the vehicle 512 to go left, or right bar 548B would be contacted on its right side by roller diverter 515B to force the vehicle to go right. In this view, roller diverter 515B is in a down position and 515A is in an up position, so the vehicle will be forced to make a right turn. After the turn, the lowered diverter roller returns to the up position.

In the junction 510 the left side of the center bar 548A maintains a fixed distance to the alpha rail 506A and the right side of center bar 548B maintains a fixed distance to the beta rail 506B.

Having a center diverter bar above the level of other rails requires vehicles' lowest point to clear the center bar. This lowest point may be the vehicle's 512 axle or chassis.

DESCRIPTION FIG. 5B

FIG. 5B is an end view 500B of a vehicle 512 at a junction 510 using center bars. The vehicle's diverters 515A or 515B will contact either left center bar 548A left side surface or right center bar 548B right side surface. This is a sectional view C-C' from FIG. 5A. The vehicle 512 on rails 506A and 506B is approaching center bars 548A and 548B. Left roller diverter 515A is raised and right roller diverter 515B is lowered and ready to contact the right center bar 548B side surface. Diverter rollers rotate around axles 532A and 532B which slide up and down in tubes 552A and 552B. Actuating means is not illustrated. An axle between rail wheels is not illustrated for clarity.

DESCRIPTION FIG. 5C

FIG. 5C is a top view 500C of a vehicle 512 in a turn using center bar 548B side surface. The vehicle 512 is in junction 510 and in a right turn moving Northeast. Observe that right roller diverter 515B is about to separate from right center bar 548B, and flange on front wheel 518C is approaching a gap 554. The roller on diverter 515B did not hit delta rail 506D because it extended down only far enough to engage center bar 548B, but not far down enough to hit delta rail 506D, or any other rails for that matter. Also observe that flange on wheel 518D is passing through a flange gap 508B without interference.

DESCRIPTION FIG. 6A

Figure 6D:
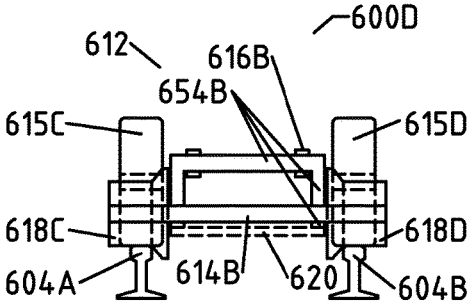
FIG. 6D is an end view of a vehicle supported by rails.
Figure 6B:
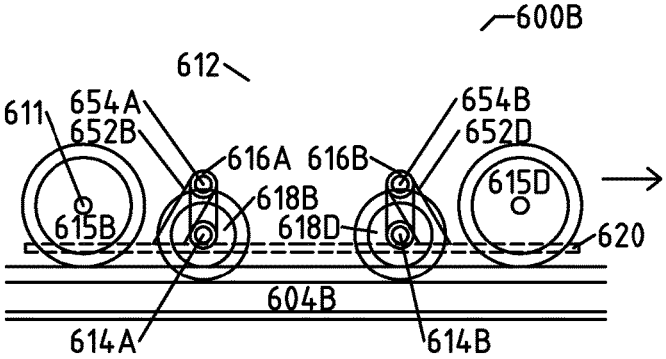
FIG. 6B is a side view of a vehicle traveling on a rail.
Figure 6A:
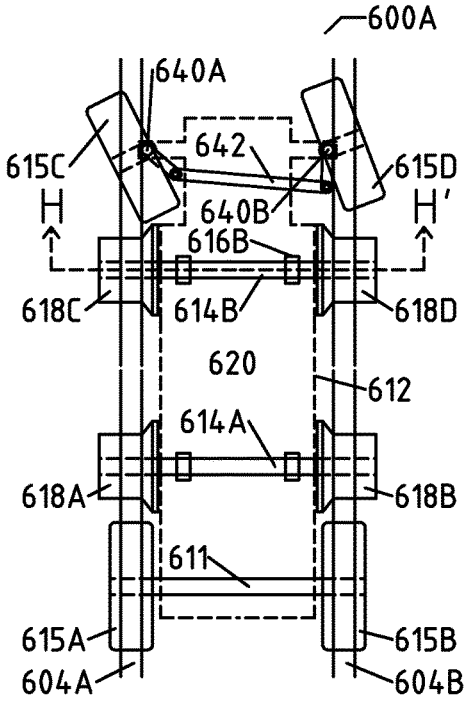
FIG. 6A is a top view of a vehicle using rubber wheels to apply lateral force.

FIG. 6A is a top view 600A of a vehicle 612 using rubber road wheels to apply lateral force, allowing the vehicle 612 to make a turn at a junction (not illustrated). The vehicle 612 has an additional ability, like prior art hi-rail vehicles, to leave the rail and travel on roads, and then return to rail travel. The vehicle 612 has a chassis 620 illustrated as dashed lines. The vehicle 612 is supported on the rail by 4 rail wheels 618A-D with flanges and wide cylindrical sections that each rotate freely around axles 614A-B, and 4 road wheels 615A-D. While on rails 604A and 604B, the road wheels 615A-D contact the tops of the rails and support a share of the vehicle's weight. The rear road wheels 615A-B are driven and provide traction to make the vehicle move. Rear road wheels are mounted on a rear axle 611. Front road wheels 615C-D also support a portion of the vehicle's weight and additionally, when turned as illustrated, provide lateral force. This lateral force has an effect like other diverters, forcing the vehicle to turn right, left, or travel straight ahead. Normally, all wheels are pointed straight ahead unless approaching or in a junction.

All four road wheels and rail wheels can provide breaking force to the tops of the rails.

The front wheels 615C and 615D are steerable but are not turned for straight (non-junction) rail travel. The front wheels are illustrated as using an Ackerman steering mechanism with kingpins 640A-B and a connecting rod 642. The front wheels are applying lateral force to the left

DESCRIPTION FIG. 6B

FIG. 6B is a side view 600B of a vehicle 612 traveling on a rail 604B. The chassis 620 supports vehicle components above the rail 604B. In this view front road wheel 615D and rear road wheel 615B are both contacting the rail and are aligned with the rail for straight travel. Rail wheels 618B and 618D are lowered and also contacting the top surface of the rail 604B. The flanges on rail wheels keep the vehicle and all road and rail wheels on the rail. Rail wheels 618B and 618D, and rail wheel axles 614A-B pivot around bushings 616A and 616B. Bushing supports 652B and 652D support the bushings 616A and 616B from the chassis 620. Rear road wheels rotate on axle 611 which may be driven and may contain a differential gear mechanism.

Rail wheels on both sides of the vehicle 612 rotate around bushings 616A and 616B to raise and lower the rail wheels. The rail wheels on a common axle raise and lower together because axles 614A-B are mounted on U-shaped bars 654A and 654B which rotate around bushings 616A and 616B respectively.

DESCRIPTION FIG. 6C

Figure 6C:
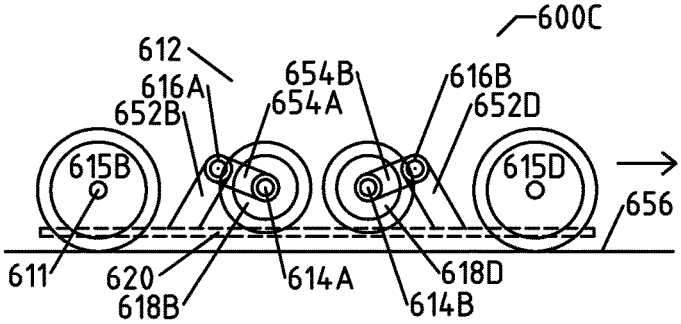
FIG. 6C is a side view of a vehicle traveling on a road.

FIG. 6C is a side view 600C of a vehicle 612 traveling on a road 656. The rail wheels 618B-D are mounted on axles 614A and 614B are elevated and may not be rotating. The rail wheels and their axles are retracted (or elevated, or lifted) for road (off rail) travel by rotating the axles 614A and 614B and U-shaped bars 654A and 654B around bushings 616A and 616B. Axles 614A and 614B are inserted into the U-shaped bars 654A and 654B. U-shaped bars may be rotated around bushing 616A and bushing 616B together or separately, and may be rotated by linear or rotary actuators, which may be hydraulic, pneumatic, electric, or manually cranked.

DESCRIPTION FIG. 6D

FIG. 6D is an end view 600D of a vehicle 612 supported by rails 604A and 604B. This is a sectional view H-H' from FIG. 6A. Steerable road wheels 615C and 615D are pointed straight ahead in this figure. The road wheels 615C and 615D and rail wheels 618C and 618D are rolling on the tops of the rails. U-shaped bar 654B connects rail wheel axle 614B to bushings, such as bushing 616A. Bushings are connected to chassis 620 via bushing supports 652B-D which are not illustrated in this figure.

The vehicle 612 can dismount the rails to travel on pavement when the rails, such as rail 604A and 604B, sink into the pavement. To mount the rails, vehicle 612 drives onto rails that are rising out of the pavement. Using computer vision, track sensors and actuators, vehicles should be able to mount and dismount rails without stopping.

DESCRIPTION FIG. 7A

Figure 7B:
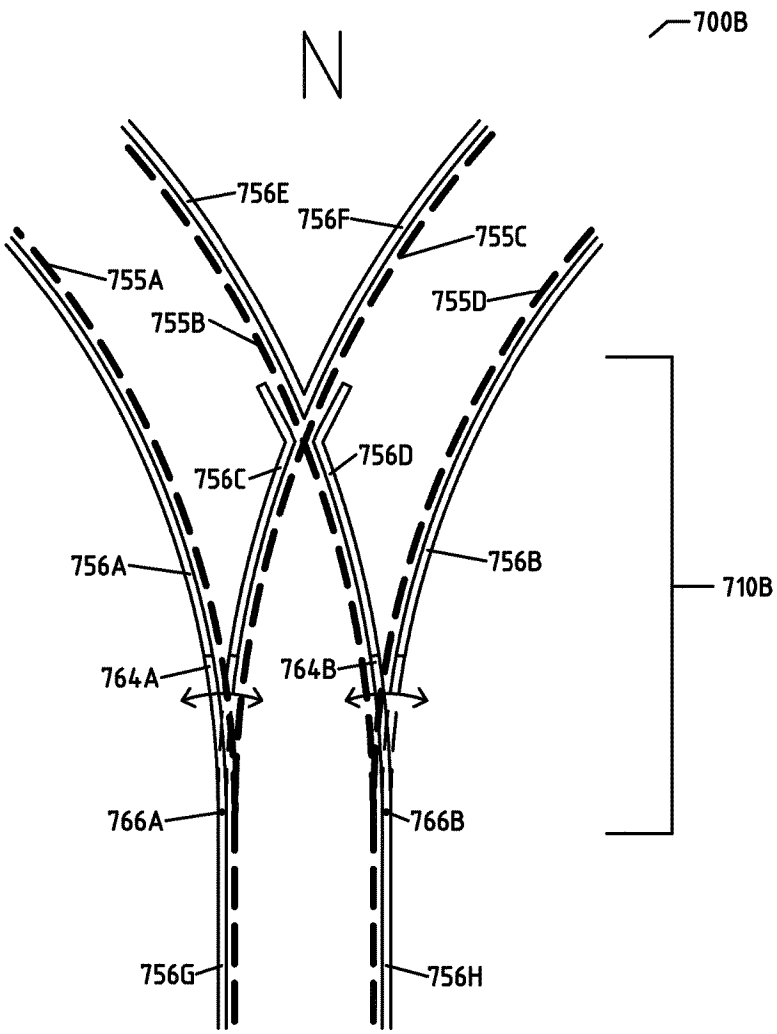
FIG. 7B is a top view of a junction using swing rails that make the junction compatible with existing trains.
Figure 7A:
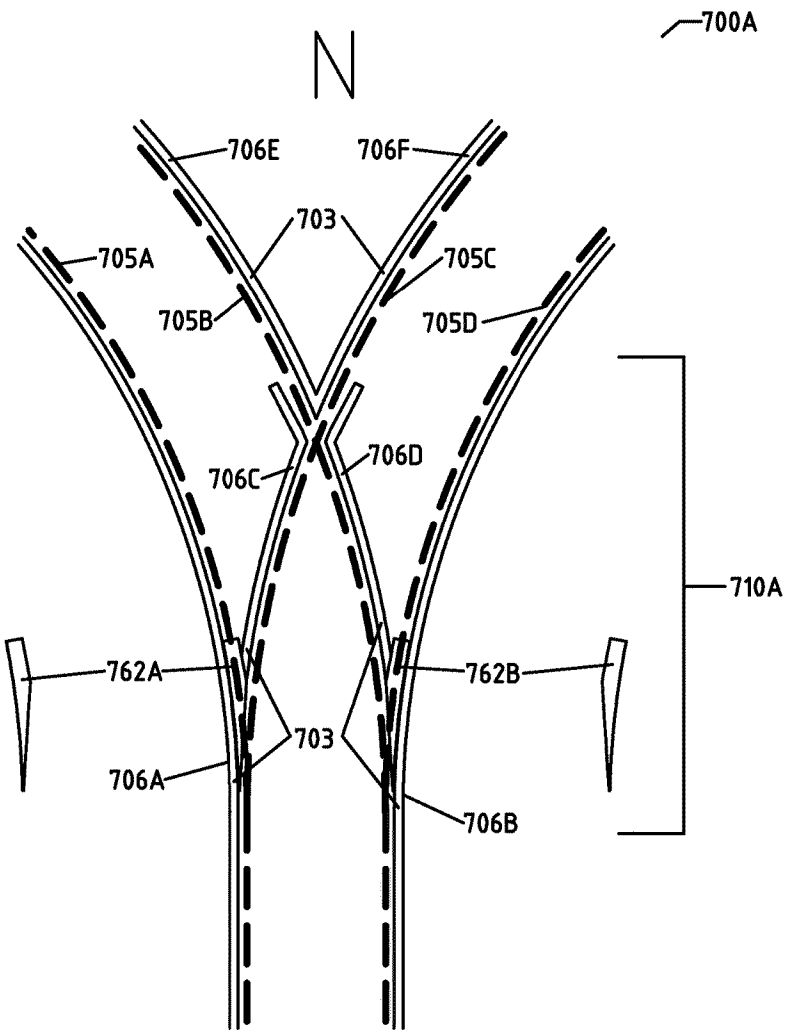
FIG. 7A is a top view of a junction using elevated wedge blocks that make the junction compatible with existing trains.

FIG. 7A is a top view 700A of a junction 710A using elevated left wedge block 762A and right wedge block 762B that make the junction 710A compatible with existing trains or trams. The junction contains rails 706A-F which are the same rails used in the junction 110, but with two additional movable wedge blocks. The wedge blocks 762A-B are illustrated as in position in the rails, and also as separate outside pieces. The junction 710A allows switching compatibility for existing vehicles that use switches (or points), such as trains or trams. This allows a vehicle 112 of the present invention to choose its own route when both sliding wedges 762A and 762B are retracted (or lowered or removed). When the left sliding wedge block 762A is up and right sliding wedge block 762B is down, all vehicles are forced to turn right. When sliding wedge block 762B is up and sliding wedge block 762A is down, all vehicles are forced to turn left. Both wedges up at the same time is an invalid mode for safe travel. Both wedges down enable vehicle 112 to decide its own route without any track movement. Tops of either wedge, while in the up position, are a same height as the tops of tracks 703. In the down position, the tops of wedges allow clearance for wheel flanges.

Also illustrated as heavy dashed lines are flange paths 705A, 705B, 705C, and 705D. These flange paths extend below the rail top surfaces and are used for clearance by front and back wheel flanges when vehicles are making left or right turns. Flange path 705A passes through rails 706A and 706C. Flange path 705B passes through rails 706C and 706E. Flange path 705C passes between rails 706D and 706F. Flange path 705D passes between rails 706D and 706B. Observe that a flange path is blocked when a wedge block is raised.

A design consideration of the sliding wedges is that they must partially support a potentially heavy vehicle while in the up position. Means, such as levers or ramps to raise and lower sliding wedges are not illustrated. Spacing between an inside of the wedge, such as wedge 762B and an opposite wedge, such as wedge 762A should remain constant in the junction to prevent derailment of prior art vehicles.

DESCRIPTION FIG. 7B

FIG. 7B is a top view 700B of a junction 710B using swing rails 764A and 764B that make the junction compatible with existing trains. The junction 710B is comprised of an upper alpha rail 756A, an upper beta rail 756B, a gamma rail 756C, a delta rail 756D, an epsilon rail 756E, a zeta rail 756F, a lower alpha rail 756G and a lower beta rail, 756H, the left swing rail 764A and the right swing rail 764B. Top surfaces for all rails have substantially a same height.

Outside rails in the junction 710B have outside side surfaces on the left and right sides. Swing rail allows switching compatibility for existing vehicles that currently use movable switches (or points), such as trains or trams. Left swing rail 764A and a right swing rail 764B swing (or pivot) laterally in a horizontal plane and are supported from underneath by a support structure, such as a metal plate (not illustrated). The swing rail 764A and 764B may be anchored at anchors points 766A and 766B, or they may be anchored or attached to North ends of the lower alpha rail 756G and the lower beta rail 756H.

The swing rail 764A is sufficiently long and flexible to bend from alignment with the South end of alpha rail 756A to alignment with South end of gamma rail 756C. Likewise, the swing rail 764B is sufficiently long and flexible to bend from alignment with the South end of beta rail 756B to alignment with South end of delta rail 756D.

For vehicles 112 of the present invention to turn left or right in the junction 710B, the left swing rail 764A is swung left to connect with the alpha rail 756A and the right guide arm 764B is swung right to connect with beta rail 756B. For a conventional tram to go right, left swing rail 764A connects with gamma rail 756C and right swing rail 764B connects with beta rail 756B. In this position the spacing between swing rails must be the normal rail-to-rail spacing. For a conventional tram to go left, left swing rail 764A connects with alpha rail 756A and right swing rail 764B connects with delta rail 756D. Again, in this position the spacing between the 2 swing rails maintain the normal rail-to-rail spacing to provide continuous support for conventional rail wheels without a wide cylinder. Swing rail 764A should not be set to the right while 765B is set to the left.

Also illustrated as heavy dashed lines are flange paths 755A, 755B, 755C, and 755D. These flange paths extend below the rail top surfaces and are used for clearance by front and back wheel flanges when vehicles are making left or right turns. Flange path 755A passes through rails 756A and 756C. Flange path 755B passes through rails 756C and 756E. Flange path 755C passes between rails 756D and 756F. Flange path 755D passes between rails 756D and 756B. Observe that flange paths are blocked when swing rail 764A is swung right or swing rail 764B is swung left.

Means to move swing (or pivot or guide) arms 764A and 764B horizontally are not illustrated, but may be manual or automatic, electrical, hydraulic, pneumatic etc. The longer the swing rails, the less force will be required for lateral arm movement.

DESCRIPTION FIG. 8A

Figure 8A:
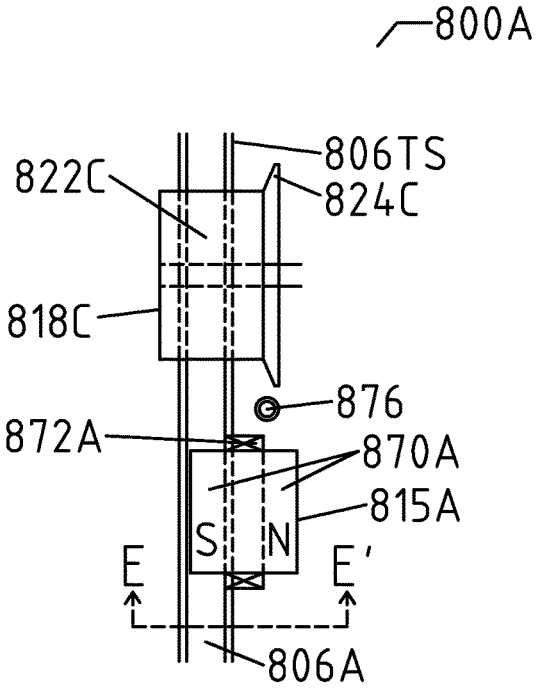
FIG. 8A is a top view of a first magnetic diverter.

FIG. 8A is a top view 800A of a first magnetic diverter 815A. The diverter 815A produces lateral force by pulling a U-shaped electromagnet 870A towards a rail 806A by magnetic attraction towards the rail 806A. Only a left side is illustrated. A chassis is not illustrated. The method produces lateral force towards the left. The electromagnet is attracted to a ferrous (steel) rail and also pulls downward, but the rail wheels, such as rail wheel 818C containing a flange 824C and a wide cylindrical surface 822C on the rail, prevent the electromagnet 870A from contacting the top of rail 806A. Electromagnets are situated above the rails and attached to the chassis, like wheels, axles, and a sensor 876. An opposing lateral force will be provided by left side wheel flange 824C when it contacts top side 806TS of rail 806A. The electromagnet is energized by a voltage source (not illustrated) connected to a coil 872A. North and south magnetic pole designations are arbitrary. AC current can also be used for activation. A sensor, such as a proximity sensor 876, can optionally be used to detect that rail 806A is in a correct position relative to rail wheel 818C for a left turn and coil current to coil 872A may be reduced. It is preferable to not have the electromagnet touch the rail, and the magnet should not create excessive force between the wheel flange 824C and the rail 806A, which creates friction and wear. The electromagnets, wheels, axles, and sensors are supported by the chassis and kept in a level position relative to the rail by the rail wheels and rail wheel flanges. Electromagnets may be left off (no current) when not approaching a junction.

DESCRIPTION FIG. 8B

Figure 8B:
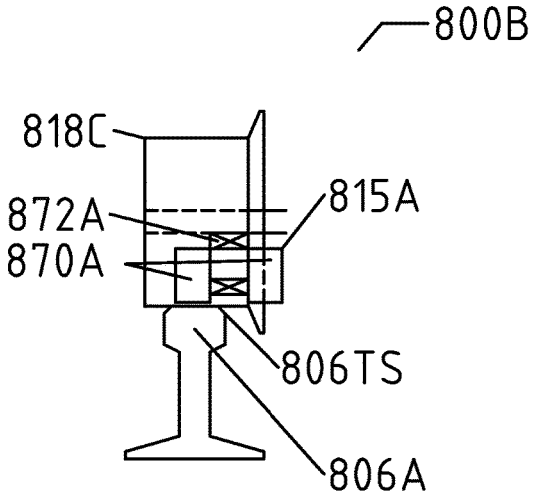
FIG. 8B is a sectional end view of a first magnetic diverter.

FIG. 8B is a sectional (E-E' in FIG. 8A) end view 800B of first magnetic diverter 815A. This view illustrates electromagnet 870A in position relative to rail 806A and wheel 818C. The coil 872A is illustrated. The sensor 876 (not illustrated) may be situated ahead of or behind the magnetic diverter 815A and should activate when the flange 824C is about to contact the top side surface of rail 806A.

DESCRIPTION FIG. 8C

Figure 8C:
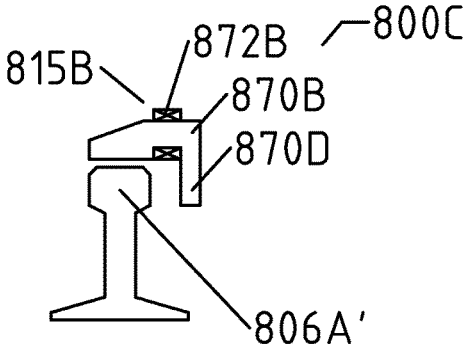
FIG. 8C is an end view of a second magnetic diverter.

FIG. 8C is an end view 800C of a second magnetic diverter 815B. The diverter 815B has electromagnet 870B with an L-shape. It features the electromagnet 870B with a coil 872B attracted to rail 806A'. Because of a L-shape it will both pull a rail wheel (not illustrated) down onto the rail and towards the rail. The down leg of the electromagnet 870D is situated behind a rail wheel flange (not illustrated) to avoid hitting a point at a junction.

An alternative use for an electromagnet is to prevent the vehicle from lifting off the tracks, such as when wind is encountered, or a turn is taken at high speed. An additional sensor (not illustrated) detecting the top of the track can be installed to direct the application of current into coils when rail wheels lift off rails.

Alternately, the inductance and Q (quality factor) of coil 872A-B can be measured used to determine the nearby presence of the rail 806A-B, as inductance will be lower when the rail is not near the magnet 870A-B. Q will also be lower. Inductive reactance can be determined as an applied AC voltage divided by applied AC current, ignoring resistive losses. An alternate method of proximity detection is to make a resonant circuit with the coil's 872B inductance and a capacitor (not illustrated). When the Q of the resonant circuit drops, the rail is in proximity.

Alternative Embodiments and Applications

All technology previously developed for rail systems, trains and trams can potentially be utilized to enable the present system.

This invention, like all rail technology, is made safe by design. For safety, a vehicle should be programmed to have a default turn direction, such as "left". A vehicle will always turn this direction at a decision point unless a countermanding order is given. Furthermore, the countermanding order, either manual, preprogrammed, supplied by an on-board computer, or supplied by a TCS (traffic control system), must be given before a start of a decision distance is reached, or it should be ignored.

A vehicle going into a junction from the South with both diverters up should be avoided. Although derailment is not a given, outcome is uncertain, made even more uncertain by high vehicle speed. From model testing, a vehicle going into a junction will have a 50-50 chance of going one way or the other because of symmetry. Vehicles going through a turnout will have a low probability of turning versus going straight.

A second safety feature is limiting speed. A TCS or on-board computer will tell a vehicle what speed to use. If contact with a TCS is lost, speed should be reduced to a default low value, or a value preprogrammed into the vehicle's computer depending on GPS (global positioning system) data.

There are several optional ways to apply lateral or side force to a vehicle to make it turn left, turn right, or go straight ahead at a junction. First, if the vehicle is being pulled by a horse, the horse can pull the front wheels of a vehicle to a desired direction with a "Gee" or "Haw" voice command from an operator to make a turn. This simple method is a directed force supplied by the animal. A second simple way is to have a human force or push the vehicle to the left or right when the front wheels are approaching an end of a decision distance. This is not an unreasonable method in undeveloped regions having tracks with infrequent junctions, when said vehicle is not too heavy. This is also reasonable when vehicle is lightweight and powered by human power, solar power, batteries etc.

At a decision point the operator can press a right or left pedal or lever to manually operate a diverter, which does not necessarily need to have a roller, but could use a low-friction non-rotating surface, such as a slippery PTFE (Polytetrafluoroethylene) or nylon coating on a bar.

A third method is to steer the front wheels to the left or right at the decision distance, as illustrated in FIGS. 6A-D. A fourth method is to apply force to side surfaces of tracks with diverter rollers illustrated in FIGS. 1B-F. A fifth method is to use an external sidebar with a diverter roller to force the wheels in a direction, illustrated in FIG. 4A-B. A sixth method is to use a center bar under a vehicle to choose directions, illustrated in FIG. 5A-C. A seventh method is magnetic attraction to the desired rail illustrated in FIGS. 8A-C. An eighth method is to tilt the tracks in a desired or default direction, so gravity pulls the vehicle in a primary direction unless it uses a diverter to oppose gravity.

A vehicle can be moving or stationary when lateral force is applied, or stationary. Less force is generally required when a vehicle is moving.

Another topic is how a vehicle and TCS knows where the vehicle is located, and exactly where it is relative to a decision point. GPS (global positioning system) is one method. Another is to put an object along the tracks to inform a sensor on the vehicle that a decision point is ahead, and where it is located. This object can be a retroreflector or mirror for optical sensors, metal plates for switches or magnetic sensing. Radio waves can also be used to locate a vehicle.

Radio waves can also be used for Internet access as well as to communicate to the TCS the current location of the vehicle, as well as confirm to a vehicle where it is located. The location system should also tell a vehicle if the decision point is ahead or behind. If a horseshoe magnet was located along the tracks a North pole followed by a South pole would tell a vehicle with an inductive pickup sensor that a decision point was just ahead. Maintenance crews can modify decision point sensors for roads being repaired or on a temporary or emergency basis.

It is anticipated that this rail system and vehicles will be connected to the World Wide Web or Internet, but sufficiently secure to avoid "hacking". That is, permission to read TCS data should be secure. Permission to write to data a TCS system should be very, very secure. Fiber optic cables accompanying the tracks are anticipated, given the economic value of a right-of-way and the cost of data infrastructure. It is desirable to have the rail system supply its own communications system rather than relying on an external service, such as cell towers or satellite systems. Fiber optic lines can supply data signals to Wi-Fi access points situated along the rail system with radio beam patterns pointed up and down the tracks to communicate with vehicles. The Internet can be used to communicate to the TCS where the vehicle is located, as well as information about where passengers are, where they are going, and for security. Employing high resolution cameras is important for security, particularly when no driver is operating a vehicle. The internet can also supply data services to passengers for work or entertainment. In addition to supplying passenger data, vehicle data, and TCS data, the rail right-of-way and fiber optic lines may be used for transporting other backbone data services, such as connecting remote communities to the Internet.

It is assumed that vehicles' on-board systems and TCS will operate with computers employing RAM, ROM, central processing units, and stored programs. Furthermore, the computers will be interconnected with wired and/or wireless networks.

Yet another topic is powering. Using renewable energy sources is important, including electricity derived from solar, wind, nuclear, hydro, animal, or human power. Overhead lines can be used, or powering can be done from a location in the tracks. If batteries are used, they can be charged while the vehicle is parked or stopped, and power can be regenerated when the vehicle is going downhill or breaking. Power can be put back into the powering network or into onboard batteries.

In windy areas vehicles can use sails for propulsion. Low vehicle rolling resistance is useful for this mode of propulsion as well as battery backup. Wind can be used to charge a vehicle's energy storage (e.g. batteries) as well as for propulsion.

With a TCS, vehicles can form into ad-hoc trains to lower wind resistance for each other. This allows higher speed travel with less energy expended. Private vehicles can share the rails with mass transit vehicles. Vehicles can group together to minimize the duration of red lights traffic signals for cross traffic.

In mass transit, vehicles (or train cars) can couple and decouple and exchange passengers while traveling. So instead of waiting at a station to get onto another rail line, a passenger walks between moving coupled cars to take a different route after the cars decouple. At train stations, shuttle vehicles can pick up passengers, bring them to a passing train, and then decouple with passengers getting off at a next station. In England and Ireland, a rail exit-only method was used in the 1930's and called "slip coaches" or a "flying switch".

Once getting on mass transit, passengers can be kept moving to their destinations through junctions by passengers simply changing cars (vehicles) which detach and split at junctions by decoupling. The same technique works for packages and mail that can be coded with a label with their destination as well as routing instructions. Packages can be automatically sorted and transferred to another car (vehicle) headed to another destination while the vehicle is in motion.

Likewise, late at night after scheduled service has suspended, passengers request rides using their cell phones and can get rides on an as-requested basis by a roaming vehicle controlled and operated by the TCS.

A privately-owned vehicle can take an owner to work, and then gather fares for hire during the day, returning to give the owner a ride home. This saves on parking fees and increases equipment utilization.

Alternately, a vehicle could be directed to a sunny non-shaded location in which to charge its batteries from vehicle rooftop solar cells.

Model vehicles can be made for a toy train market. Magnets in the tracks and Hall effect magnetic sensors on the model vehicles can inform the vehicle when a decision point is coming, so the models can be programmed to run in complex patterns on their own over the tracks, or under operator control, or under a TCS control. Games or races can be organized.

Vehicles, such as vehicle 112 can tow trailers. The connection between vehicles and trailers can be rigid bars with a pivot point on the back of the vehicle and another pivot point on the front of the trailer. On model testing, trailers follow a vehicle through a turn because the vehicle ahead at a junction pulls the trailer to the right or left using a directed force.

Vehicle of the present invention can be used in funicular railway. A funicular is a form of cable railway which connects points along a railway laid on a steep slope. Two counterbalanced cars are permanently attached to opposite ends of the haulage cable, which is looped over a pulley at the upper end of a track. The two cars move in concert: as one ascends, the other descends. A turnout would allow a vehicle of the present invention going up on a track to pass a vehicle going down on the same track.

For the vehicle illustrated FIG. 6, an alternate steering method called "skid steering" is anticipated. A turn can be made by increasing the speed of the road wheels one side of the vehicle relative to the other side. Skid steering can be used both on rail and on road. This vehicle steering method is also useful for vehicle travel in gravel and dirt.

The electromagnet illustrated in FIGS. 8A-B can be rotated 90 degrees and used to create lateral force by pulling towards one of the outside side bars as illustrated in FIG. 3. An advantage of a rotated electromagnet is that the attraction force will be purely lateral.

A center bar and a pair of roller diverters are illustrated in FIG. 5A-C. The pair of diverters may be replaced with a single roller diverter that is moved from the right to the left side before approaching a decision distance. This single diverter can be swung with a swing arm from a left position to a right position before being lowered. A motivation for a single diverter would be weight or cost reduction.

Drawings are for illustration and explanation purposes and not necessarily to scale.

Changes may be made in the above methods and systems without departing from the scope hereof. It should thus be noted that the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall therebetween.

What I claim is:

1. A stationary rail system junction (110) comprised of an alpha rail (106A), a left side surface (104A), a beta rail (106B), a right side surface (104B), a gamma rail (106C), a delta rail (106D), an epsilon rail (106E), a zeta rail (106F), a rail top surface (103) on alpha, beta, gamma, delta, epsilon and zeta rails at substantially a same height at said junction, a first flange path (105A) below said rail top surface that is situated between the alpha rail and the gamma rail, a second flange path (105B) below rail top surface situated between the gamma rail and the epsilon rail, a third flange path (105C) below rail top surface situated between the delta rail and the zeta rail, and a fourth flange path (105D) below rail top surface situated between the beta rail and the delta rail, a vehicle (112), a front right rail wheel (118D) with a flange and a wide cylinder, a front left rail wheel (118C) with a flange and a wide cylinder, a rear right rail wheel (118B) with a flange and a wide cylinder, a rear left rail wheel (118A) with a flange and a wide cylinder, a right diverter (115A), a left diverter (115B), where said vehicle turns left at said junction by left diverter forcing front left rail wheel flange into said first flange path (105A) causing said vehicle to turn left at said junction.

2. A rail system according to claim 1 where the right diverter is a roller for contacting the right side surface, and the left diverter is a roller for contacting the left side surface.

3. A rail system according to claim 1 where the diverter is an electromagnet attracted to the alpha rail or an electromagnet attracted to the beta rail.

4. A rail system according to claim 1 where left side surface is situated on the outside of the alpha rail and right side surface is situated on outside of the beta rail.

5. A rail system according to claim 1 further comprising a left outside sidebar and a right outside sidebar, where the left side surface is situated on the left sidebar and the right side surface is situated on the right sidebar.

6. A rail system according to claim 1 further comprising a left center bar and a right center bar where the left side surface is situated on the left center bar and the right side surface is situated on the right center bar.

7. A rail system according to claim 1 where the alpha rail and the beta rail increase their separation over a decision distance.

8. A rail system according to claim 1 where said diverters are steered road wheels.

9. A rail system according to claim 1 further comprising a left wedge block situated between an alpha rail and a gamma rail that can be elevated to force vehicles to turn right at the junction, a right wedge block situated between a beta rail and a delta rail that can be elevated to force a vehicle to turn left at the junction.

10. A system according to claim 1 where a diverter is one of an animal or a tractor vehicle pulling the vehicle forward to the right or forward to the left.

11. A system according to claim 1 where cylinder portion of wide cylinder is tapered.

12. A system according to claim 1 for maintaining a flanged rail wheel over a rail comprised of the flange on one side of the rail and a roller on the other side of the rail.

13. A system according to claim 1 where a diverter is automatically lowered by a command from a traffic control system to enable a vehicle to follow a planned route.

14. A rail system according to claim 1 where a right diverter is a roller for contacting an angled contact surface (138B) at an angle less than 90 degrees, or the left diverter is a roller for contacting an angled contact surface (138A) at an angle less than 90 degrees.

15. A rail system junction (710B) comprised of an upper alpha rail (756A), an upper beta rail (756B), a gamma rail (756C), a delta rail (756D), an epsilon rail (756E), a zeta rail (756F), a lower alpha rail (756G) and a lower beta rail (756H), a left swing rail (764A), a right swing rail (764B), rail top surfaces on upper alpha, upper beta, gamma, delta, epsilon, zeta, lower alpha, lower beta, right swing and left swing rails at substantially a same height at said junction, a first flange path (755A) below said rail top surface that is situated between the upper alpha rail and the gamma rail, a second flange path (755B) below rail top surface situated between the gamma rail and the epsilon rail, a third flange path (755C) below rail top surface situated between the delta rail and the zeta rail, and a fourth flange path (755D) below rail top surface situated between the delta rail and the upper beta rail, the left swing rail (764A) connecting between the lower alpha rail and the upper alpha rail, a right swing rail connecting between the lower beta rail and the upper beta rail, a vehicle (112), a front right rail wheel (118B) with a flange and a wide cylinder, a front left rail wheel (118C) with a flange and a wide cylinder, a rear right rail wheel (118B) with a flange and a wide cylinder, a rear left rail wheel (118A) with a flange and a wide cylinder, a right diverter (115A), a left diverter (115B), where said vehicle turns right at said junction by right diverter contacting a right side surface, applying force and causing said vehicle to turn right at said junction.

16. A system according to claim 15 where said vehicle turns left at said junction by left diverter contacting a left side surface, applying force and causing said vehicle to turn left at said junction.

17. A system according to claim 15 where the left swing rail (764A) connects between the lower alpha rail and the upper alpha rail, the right swing rail (764B) connects between the lower beta rail and the delta rail, forcing all traffic entering the junction to go left.

18. A system according to claim 15 where the left swing rail (764A) connects between the left anchor point (766A) and the gamma rail, the right swing rail connects between right anchor point (766B) and the beta rail, forcing all traffic entering the junction to go right.

19. A stationary rail system junction (110) comprised of an alpha rail (106A), a left side surface (104A), a beta rail (106B), a right side surface (104B), a gamma rail (106C), a delta rail (106D), an epsilon rail (106E), a zeta rail (106F), a rail top surface (103) on alpha, beta, gamma, delta, epsilon and zeta rails at substantially a same height at said junction, a first flange path (105A) below said rail top surface that is situated between the alpha rail and the gamma rail, a second flange path (105B) below rail top surface situated between the gamma rail and the epsilon rail, a third flange path (105C) below rail top surface situated between the delta rail and the zeta rail, and a fourth flange path (105D) below rail top surface situated between the beta rail and the delta rail, a vehicle (612)), a front right rail wheel (618D) with a flange and a wide cylinder, a front left rail wheel (618C) with a flange and a wide cylinder, a rear right rail wheel (618B) with a flange and a wide cylinder, a rear left rail wheel (618A) with a flange and a wide cylinder, two steerable road wheels (615C-615D) in contact with rails that operate as diverters, two non-steerable road wheels (615A-B), where the 4 rail wheels are lowered and the vehicle turns at a junction by turning steerable road wheels.

20. A vehicle according to claim 19 where the rail wheels are elevated and the vehicle travels over a road.

* * * * *